US009101845B2

(12) United States Patent
Cai

(10) Patent No.: US 9,101,845 B2
(45) Date of Patent: Aug. 11, 2015

(54) SEPARABLE COMBINED TOY SPINNING TOP

(75) Inventor: Dongqing Cai, Guangdong (CN)

(73) Assignees: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

( * ) Notice: Subject to any disclaimer, the term of this patent is extended or adjusted under 35 U.S.C. 154(b) by 0 days.

(21) Appl. No.: 14/362,041

(22) PCT Filed: Sep. 7, 2012

(86) PCT No.: PCT/CN2012/081099

§ 371 (c)(1), (2), (4) Date: May 30, 2014

(87) PCT Pub. No.: WO2013/078896

PCT Pub. Date: Jun. 6, 2013

(65) Prior Publication Data

US 2014/0302743 A1 Oct. 9, 2014

(30) Foreign Application Priority Data

Nov. 30, 2011 (CN) ..... 201110389906

(51) Int. Cl.
*A63H 1/00* (2006.01)
*A63H 1/18* (2006.01)

(52) U.S. Cl.
CPC ..... *A63H 1/18* (2013.01)

(58) Field of Classification Search
CPC ..... A63H 1/00; A63H 1/18; A63H 1/02; A63H 1/04
USPC ..... 446/256, 257, 260, 263
See application file for complete search history.

(56) References Cited

U.S. PATENT DOCUMENTS 1,033,671 A * 7/1912 Campbell ..... 446/69
1,089,668 A * 3/1914 Prendergast ..... 446/69

(Continued)

FOREIGN PATENT DOCUMENTS

CN 2431025 Y 5/2001
CN 102371071 A 3/2012

(Continued)

*Primary Examiner* — Michael Dennis
*Assistant Examiner* — Urszula M Cegielnik
(74) *Attorney, Agent, or Firm* — Greenberg Traurig, LLP; Weisum Rao; Robbie R. Harmer

(57) ABSTRACT

A separable combined toy spinning top, comprising a main spinning top and an auxiliary spinning top, wherein the main spinning top comprises a spinning top cover (1), a main spinning top piece (2), a spinning top shaft sleeve (3) and a spinning tip (4); the auxiliary spinning top comprises an auxiliary spinning top piece (5), a shaft sleeve body (6) and the spinning tip (4). The upper part of the auxiliary spinning top is provided with an elastic mechanism, and the main spinning top, flexibly connected onto the top of the auxiliary spinning top, is capable of disconnecting from the auxiliary spinning top and ejecting away via the elastic mechanism when hindered during rotation so that the main spinning top and the auxiliary spinning top rotate independently of each other. The separable combined toy spinning top cleverly combines two spinning tops into one, able to be separated upon impact, so that a player has a higher probability of winning in a competition while the practical abilities of a child can be developed.

6 Claims, 3 Drawing Sheets

(56) References Cited

U.S. PATENT DOCUMENTS

| | | | | | |
|---|---|---|---|---|---|
| 1,501,276 | A * | 7/1924 | Cruver | 273/147 |
| 1,985,657 | A * | 12/1934 | Gustine | 446/257 |
| D155,015 | S * | 8/1949 | Krapp | D21/460 |
| 2,619,769 | A * | 12/1952 | Gallaher | 446/69 |
| 2,657,498 | A * | 11/1953 | Gustine | 446/260 |
| 2,839,869 | A * | 6/1958 | Sanchez | 446/69 |
| 3,201,896 | A * | 8/1965 | Dalhart | 446/69 |
| 4,772,241 | A * | 9/1988 | Bro et al. | 446/202 |
| 4,959,035 | A * | 9/1990 | Murasaki | 446/40 |
| 5,941,753 | A * | 8/1999 | Diresta | 446/257 |
| 6,364,734 | B1 * | 4/2002 | Ng | 446/236 |
| 6,530,817 | B1 * | 3/2003 | Winslow et al. | 446/256 |
| 6,626,729 | B2 * | 9/2003 | Osawa | 446/250 |
| 6,746,300 | B1 * | 6/2004 | Matsukawa | 446/256 |
| 6,769,953 | B1 * | 8/2004 | Sutton et al. | 446/256 |
| 2003/0064660 | A1 * | 4/2003 | Matsukawa | 446/256 |
| 2006/0258259 | A1 * | 11/2006 | Lin | 446/256 |
| 2012/0088433 | A1 * | 4/2012 | Choe | 446/256 |

FOREIGN PATENT DOCUMENTS

| | | |
|---|---|---|
| JP | 2005-328976 | 12/2005 |
| KR | 20030059008 | 7/2003 |

* cited by examiner

SEPARABLE COMBINED TOY SPINNING TOP

FIELD OF THE INVENTION

The present disclosure relates to a toy top, and more particularly, to a detachable combined toy top.

BACKGROUND OF THE INVENTION

An existing toy top is usually consisted of a single top that comprises an axle sleeve structure, a top cap, a top piece, and a top tip, the top cap of which can be connected to a top ejector in order to eject and spin the top. In order to enhance or modify their functionality and beat a rival top in a game, the prior tops are mostly designed to be upgradable, assembled in a way that is easy for disassembling and reassembling; the axle sleeve structure is also designed to be extendable so that the top can be quickly dissembled to replace or add parts. However, no matter how strengthened they are, the prior toy tops are still spinning as just one single top and it is hard to further increase their winning chances in a spin-and-duel game. Meanwhile, the characteristic of tops of being upgradable by disassembling and reassembling has become common and insipid, and therefore hard to remain favorable for the players in the long term.

SUMMARY OF THE INVENTION

The objective of the present invention is to solve the problem in the prior art above by providing a detachable combined toy top that can be divided in two during a game, increasing the chances to win and the fun of the gameplay.

To achieve the above-mentioned objective, according to an embodiment of the invention, the disclosure herein provides a technical solution: a detachable combined toy top, including a main top and a subsidiary top, wherein the main top includes a top cap, a main top piece, a top axle sleeve, and a top tip, and the subsidiary top includes a subsidiary top piece, an axle sleeve structure, and a top tip. An elastic structure is provided on the upper portion of the subsidiary top, the main top is actively connected to the upper portion of the subsidiary top, and by means of the elastic structure, the main top can be detached from the subsidiary top and ejected out when being obstructed during rotation, such that the two tops can spin on themselves separately.

Preferably, the elastic structure above is a spring base provided on the axle sleeve structure of the subsidiary top, wherein the axle sleeve structure has a cavity to contain the spring base, and the upper end of the spring base protrudes from the axle sleeve structure so that the spring base is compressed when the main top is connected to the subsidiary top.

To allow the removable connection to unlock when clashed, preferably, the removable connection between the main top and the subsidiary top is realized by linking the main top piece and the subsidiary top piece. The main top piece and the subsidiary top piece are provided respectively with adapting pieces that can be actively connected to each other, by which the main top and the subsidiary top can be combined into one by pushing the main top onto the subsidiary top and compressing the spring base until the adapting pieces of the main top piece and subsidiary top piece are fitted and connected together. Furthermore, the subsidiary top piece is designed to be a torus, wherein the adapting pieces of the subsidiary top piece are upper holders provided at the upper edge of the inner ring of the subsidiary top, and the adapting piece of the main top piece are designed correspondingly to be lower holders fitting the upper holders. The main top piece and subsidiary top piece can be combined into one top, which can later be separated by turning, by stacking the main top piece onto the subsidiary top, staggering the lower holders and the upper holders while pressing, and then turning the main top piece so that the lower holders are snapped onto the upper holders.

Preferably, to achieve the connection between the main top and the subsidiary top secure enough yet not too tight to unlock, hemispherical bumps are provided on the lower surface of the upper holders, while correspondent hemispherical pits are provided on the upper surface of the lower holders, wherein the hemispherical pits and the hemispherical bumps form socket locks when the lower holders turn and snap onto the upper holders.

Preferably, to ensure that the main top will not separate from the subsidiary top immediately upon a clash, there are two hemispherical pits on the lower holder to fit one hemispherical bump successively before the detachment of the main top from the subsidiary top occurs.

The disclosure provides herein a top combined of a main top and a subsidiary top, wherein the subsidiary top has an elastic structure on its top and the main top is actively connected to the top of the subsidiary top and pressing against the elastic structure. When clashed during spinning, the main top can be detached from the subsidiary top by unsnapping the moveable connection and ejected out, the two tops spinning on themselves separately therefrom. As a result, the top may divides into two in a game, which substantially promoted its attack capability and the chances to win. In addition, the gameplay is novel and highly interesting, which may gain the favor of more players. The moveable connection structure of the main and subsidiary tops are provided on the main and subsidiary top pieces, so that the clash between the top pieces of two rival tops pushes the top pieces to turn, unlocking the link joint; meanwhile, there are multiple hemispherical pits on the adapting pieces of the main top for one hemispherical bump on the adapting pieces of the subsidiary top, so that the hemispherical bump will fit in multiple hemispherical pits before the final detachment of the main top from the subsidiary top. Therefore, the combined toy top will not detach upon one clash, but save the winning trick to the critical moment, which increases the randomness of the top duels and further increase the fun of the gameplay. Overall, the detachable combined toy top is an ingenuous design that combines two tops in one, which can be detached by a clash of the rival, giving the player higher chances to win in a game; meanwhile, it can also help develop the manual dexterity and competitive capacity of the children.

The disclosure will be explained in more details below with drawings and embodiments.

DETAILED DESCRIPTION OF THE PREFERRED EMBODIMENTS

Figure 1:
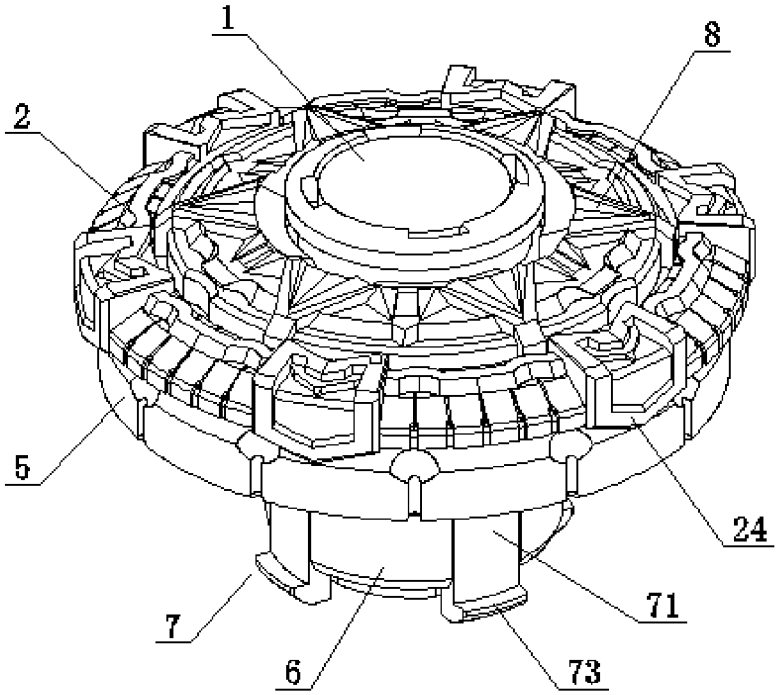
FIG. 1 shows a dimensional structure view of the toy top according to one embodiment of the present disclosure.
Figure 2:
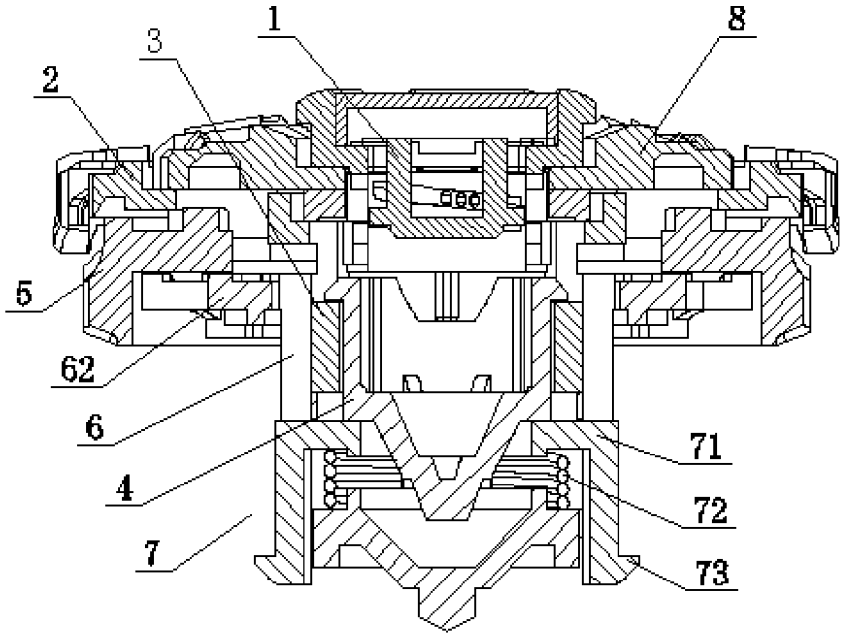
FIG. 2 shows a section structure view of the toy top according to one embodiment of the present disclosure.
Figure 3:
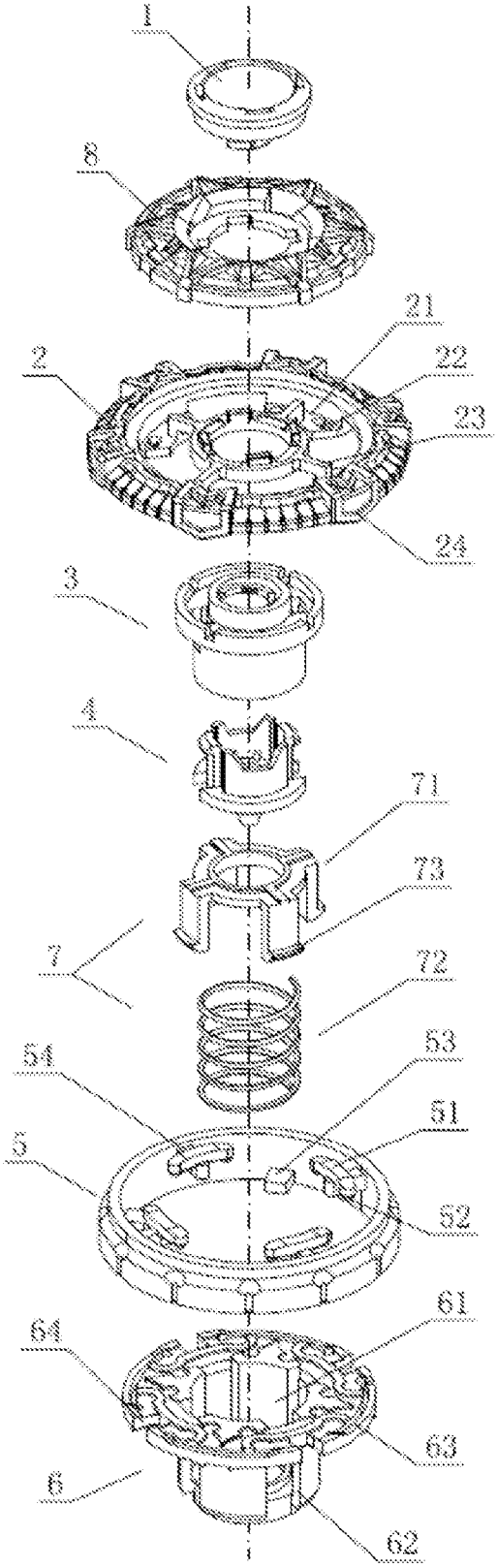
FIG. 3 shows an exploded structure view of the toy top according to one embodiment of the present disclosure.

As shown in FIG. 1 through FIG. 3, the embodiment herein provides a detachable combined toy top that comprises a main top and a subsidiary top, wherein the main top includes a top cap 1, a main top piece 2, a top axle sleeve 3, and a top tip 4, while the subsidiary top includes a subsidiary top piece 5, an axle sleeve structure 6, and a top tip 4. The subsidiary top has an elastic structure on its top, and the main top is actively connected to the top of the subsidiary top. By the elastic structure, when clashed during spinning, the main top can be detached from the subsidiary top and ejected out, and the two tops spinning on themselves separately therefrom. As a result, the top divides into two in a game, which substantially promotes its attack capability and the chances to win. In addition, the gameplay is novel and highly interesting, which may gain the favor of more players.

As shown in FIG. 3, in this embodiment, the elastic structure above is a spring base 7 provided on the axle sleeve structure 6 of the subsidiary top, wherein the axle sleeve structure 6 has a cavity 61 to contain the spring base 7, with the upper end of the spring base 7 protruding above the axle sleeve structure 6 so that the spring base 7 is compressed when the main top is connected to the subsidiary top. The assembled structure is shown in FIG. 2. The spring base 7 in this embodiment includes a ring base 71 and a spring 72, wherein snap-fit tabs 73 is formed in downward extension of the ring base 71, while the wall of the cavity 61 is provided with strip snap-fit grooves 62; snap-fitting of the snap-fit tabs 73 into the strip snap-fit grooves 62 allows the movement of the ring base 71 in the strip snap groove 62; the spring 72 is installed between the ring base 71 and the cavity 61 so that the ring base 71 can move elastically. The moveable connection between the main top and the subsidiary top in this embodiment is realized by linking the main top piece 2 and the subsidiary top piece 5, the two of which can be combined into one by pushing the main top onto the subsidiary top and compressing the spring base 7 until the adapting pieces of the main top piece 2 and subsidiary top piece 5 are connected together.

Figure 4:
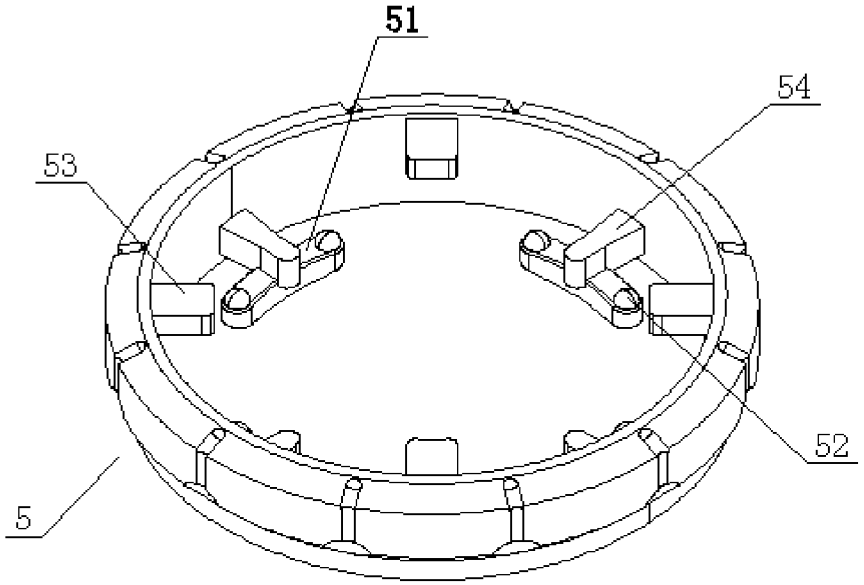
FIG. 4 shows a dimensional structure view of the subsidiary top piece according to one embodiment of the present disclosure.
Figure 5:
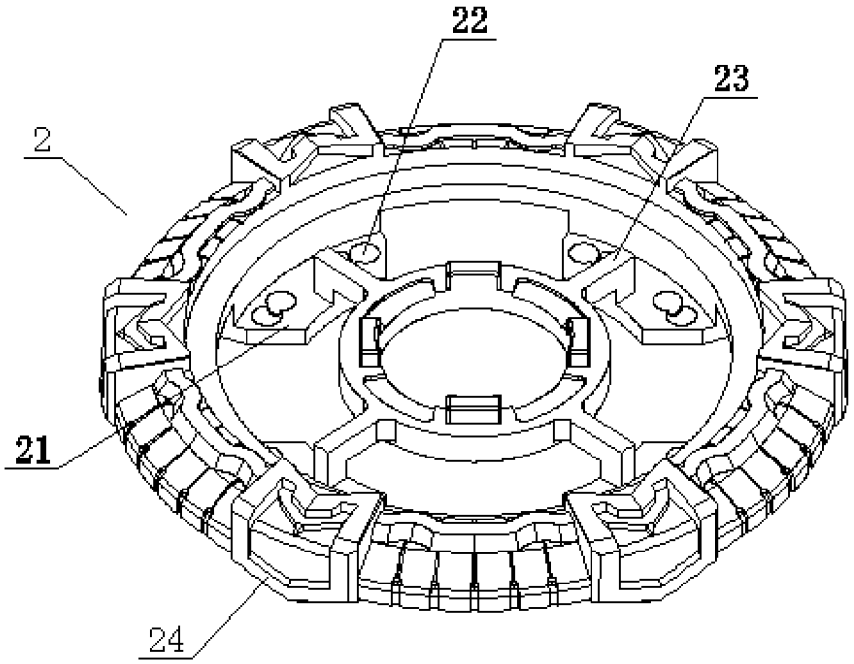
FIG. 5 shows a dimensional structure view of the main top piece according to one embodiment of the present disclosure.

As shown in FIG. 4, the subsidiary top piece 5 is designed to be a torus, wherein the adapting pieces of the subsidiary top piece 5 are the upper holders 51 at the upper edge of the inner surface of the torus of the subsidiary top piece 5. In this embodiment the junction plates 54 is provided on the inner ring of the subsidiary top piece 5: four junction plates 54 in total, evenly distributed in a ring. Each of the left and right ends of each junction plate 54 has an upper holder 51, which forms a "T" shape with the junction plate 54 and has hemispherical bumps 52 on its lower surface. The outer surface of the torus of the subsidiary top piece 5 adopts a bumpy texture, which promotes the aesthetics and attack capacity of the top at the same time. As shown in FIG. 5, in this embodiment, the main top piece 2 is also a torus, with another small torus in the middle, and the two toruses are connected by four bracing bars 23. The adapting piece of the main top are designed to be lower holders 21 for cooperating with the upper holders 51, wherein the lower holders 21 bulge on the edge of the inner surface of the torus, one on each of the left and right ends of each bracing bar 23. There are two hemispherical pits 22 on the upper surface of each lower holder 21, corresponding to a hemispherical bump 52. In this embodiment, there are a plurality of attack portions 24 on the outer surface of the main top piece 2, which protrude out from the edge of the main top piece 2. The attack portions are cone-shape attaching blocks, six in total, with bumpy texture between each two units, making the main top piece 2 the attacking top piece of the combined top. To assemble the two top pieces in this embodiment, first staggerly align the lower holder 21 of the main top piece 2 and the upper holder 51 of the subsidiary piece 5, i.e., the lower holders 21 are aligned with the gaps in between the upper holders 51 of the subsidiary toy piece 5, and close up. Now, the lower holders 21 of the main top piece 2 pass through the gaps and locate beneath the upper holders 51 of the subsidiary top piece 5. Then, turn the main top to fasten it onto the subsidiary top according to the desired direction to eject and spin the top. If a clockwise spin is desired, then turn the main top counter-clockwise against the subsidiary top, so that the lower holders 21 on the right end of the bracing bars 23 fasten onto the upper holders 51 on the left side of the subsidiary top, meanwhile matching the interior hemispherical pits 22 to the hemispherical bumps 52 on the upper holder 51. If a counter-clockwise spin is desired, then turn the main top clockwise against the subsidiary top, so that the lower holders 21 on the left end of the bracing bars 23 fasten onto the upper holders 51 on the right side of the subsidiary top, meanwhile matching the interior hemispherical pits 22 to the hemispherical bumps 52 on the upper holder 51. Therefore during a game, when the toy top is clashed for the first time by an impact force that is large enough to turn the main top piece 2, the main top will not unlock immediately from the subsidiary top; instead, the hemispherical bumps 52 move to match with the exterior hemispherical pits 22 of the main top piece 2. When another clash occurs that turns the main top piece 2 again, the hemispherical bumps 52 will slide out of the hemispherical pits 22, and the upper holders 51 and the lower holders 21 are completely dislocated. At this time, the spring base 7 recovers its elasticity and ejects out the main top, so that the main top and the subsidiary top disengage and spin separately.

As shown in FIG. 3, in this embodiment, the axle sleeve structure 6 of the subsidiary top has an enveloping edge 62 on the outward extension of its the upper edge, wherein the enveloping edge 62 has snap holes 63. The subsidiary top piece 5 has a snap block 53 on its lower part and a stop block on its upper part, wherein the vertical distance between the snap block 53 and the stop block is equal to the thickness of the enveloping edge 62. The subsidiary toy piece 5 can be fastened onto the axle sleeve structure 6 by pushing the snap blocks 53 through the snap holes 63 and turning. The stop blocks in this embodiment are the junction plates 54 that connect the upper holders 51. The main top piece 2 of the main top has a weight stack 8 connected to its top, which is fastened between the top cap 1 and top axle sleeve 3 by connection of the top cap 1 and top axle sleeve 3. The main top piece 2 is fastened on the top of the top axle sleeve 3, while the top tip 4 of the main top is installed on the lower tip of the top axle sleeve 3.

The top disclosed herein can be applied to top duel games. Many kinds of main top piece 2 can be derived from this design with different attacking capacities. The players can assemble the main top according to their choices, assemble the subsidiary top, and decide whether the top should spin clockwise or counter-clockwise. Afterwards, the main top can be fastened onto the subsidiary top by the movable connection between the main top piece 2 and the subsidiary top piece 5. At the start of the game, the dueling players can eject their tops onto the playground, where the two tops clash against each other; during the clashing, the main top of the combined top will turn in an opposite direction relative to the subsidiary top, until the hemispherical pits 22 on the main top piece 2 and the hemispherical bumps 52 on the subsidiary top piece 5 completely disengage. Then, the main top will jump up as ejected by the spring 72 of the spring base 7 on the subsidiary top, deviate from the subsidiary top as affected by the rotational inertia force, and land on the ground on its tip 4 to continue spinning; meanwhile, the subsidiary top also continues spinning after ejecting out the main top. As a result, the combined top divides into two independent tops that spin separately, which creates a two-against-one situation, substantially enhancing the chances to win. Meanwhile, it promotes the fun of top duel games and also helps develop the manual dexterity and competitive capacity of the children.

Although the disclosure has described herein in terms of specific embodiments, such description should not mean any limitation to our disclosure. Based on the description of this disclosure, those skilled in the art will recognize that the invention-creation can be practiced in other variations within the spirit and scope of the claims.

What is claimed is:

1. A detachable combined toy top, comprising:

a main top, comprising a top cap, a main top piece, a top axle sleeve and a top tip; and a subsidiary top, comprising a subsidiary top piece, an axle sleeve structure and a top tip;

wherein an elastic structure is provided on an upper portion of the subsidiary top, the main top is actively connected to the upper portion of the subsidiary top, and by means of the elastic structure, the main top can be detached from the subsidiary top and ejected out when being obstructed during rotation, such that the two tops can spin on themselves separately;

wherein the elastic structure is a spring base provided on the axle sleeve structure of the subsidiary top, and the axle sleeve structure is provided with a cavity for containing a spring base, with an upper end of the spring base protruding above the axle sleeve structure so that the spring base is in a compressed state when the main top is connected to the subsidiary top;

wherein the spring base comprises a ring base and a spring; a snap-fit tab is provided in the downward extension of the ring base, and a wall of the cavity of the axle sleeve structure has a strip snap groove to allow the snap-fit tab to snap in; by snapping the snap-fit tab into the strip snap groove, the ring base is moveable within the strip snap groove; the spring is installed between the ring base and the cavity so that the ring base can move elastically;

wherein a moveable connection between the main top and the subsidiary top is realized by connection of the main top piece and the subsidiary top piece, each of which is provided with adapting pieces that can be movably connected; the main top and the subsidiary top being combined into one by pushing the main top onto the subsidiary top and compressing downwardly the spring base until the main top piece and subsidiary top piece are fitted and connected together; and wherein the subsidiary top piece is designed to be a torus, and the adapting pieces of the subsidiary top piece are upper holders provided at an upper edge of an inner ring of the subsidiary top, and the adapting pieces of the main top piece are designed to be coupling lower holders for cooperating with the upper holders; the main top piece and subsidiary top piece are combined into one top, which can be separated by turning, by stacking the main top piece onto the subsidiary top, staggering the lower holders and the upper holders while pressing, and then turning the main top piece counter-clockwise or clockwise according to a desired clockwise or counter-clockwise direction to spin the detachable combined toy top so that the lower holders are snapped onto the upper holders.

2. The detachable combined toy top of claim 1, wherein hemispherical bumps are provided on lower surfaces of the upper holders, and complementary hemispherical pits are provided on upper surfaces of the lower holders wherein the hemispherical pits and the hemispherical bumps form socket locks when the lower holders turn and snap onto the upper holders.

3. The detachable combined toy top of claim 2, wherein two hemispherical pits are provided on the lower holders that receive the hemispherical bumps before detachment of the main top from the subsidiary top.

4. The detachable combined toy top of claim 1, wherein the axle sleeve structure of the subsidiary top has an enveloping edge on an outward extension of its upper edge; wherein the enveloping edge has snap holes; wherein the subsidiary top piece has a snap block on its lower portion and a stop block on its upper portion; wherein a vertical distance between the snap block and the stop block is equal to a thickness of the enveloping edge; wherein the subsidiary top piece can be fastened onto the axle sleeve structure by pushing the snap block through the snap holes and turning.

5. The detachable combined toy top of claim 1, wherein the main top piece of the main top has a weight stack connected to its top; wherein the weight stack is fastened between the top cap and the top axle sleeve by connection of the top cap and top axle sleeve; wherein the main top piece is fastened on the top of the top axle sleeve; wherein the top tip of the main top is installed on a lower tip of the top axle sleeve.

6. The detachable combined toy top of claim 1, wherein the main top piece of the main top has a plurality of attack portions on its outer edge, wherein the attack portions protrude out on an edge of the main top piece.

* * * * *